United States Patent [19]

Riedl

[11] 4,389,137

[45] Jun. 21, 1983

[54] OSCILLATOR FOR SOIL OR ROAD TAMPERS

[75] Inventor: Franz Riedl, Munich, Fed. Rep. of Germany

[73] Assignee: Wacker-Werke GmbH & Co. KG, Munich, Fed. Rep. of Germany

[21] Appl. No.: 323,184

[22] Filed: Nov. 20, 1981

[30] Foreign Application Priority Data

Nov. 20, 1980 [DE] Fed. Rep. of Germany ..... 3043719

[51] Int. Cl.[3] ..... E01C 19/38

[52] U.S. Cl. ..... 404/113; 74/61; 74/87; 366/125

[58] Field of Search ..... 404/113, 117; 74/61, 74/87; 366/125; 198/753

[56] References Cited

U.S. PATENT DOCUMENTS

| | | | |
|---|---|---|---|
| 2,766,629 | 10/1956 | Booth | 74/61 |
| 3,262,329 | 7/1966 | Herrmann | 74/61 |
| 3,279,338 | 10/1966 | Briggs | 404/113 |
| 3,618,485 | 11/1971 | Hermann | 404/117 |
| 3,741,669 | 6/1973 | Harris | 404/117 |
| 3,772,923 | 11/1973 | Burt | 74/61 |
| 3,832,080 | 8/1974 | Stoecker | 74/61 X |
| 3,878,733 | 4/1975 | Tertinek | 404/113 X |

*Primary Examiner*—Nile C. Byers, Jr.
*Attorney, Agent, or Firm*—Becker & Becker Inc.

[57] ABSTRACT

An oscillator or vibration exciter for soil or road tampers or compacting devices. Unbalanced shafts are journalled parallel to each other in a common housing, and are driven in opposite directions by gears which mesh with each other and are installed on the unbalanced shafts. Each shaft supports a centrifugal weight rigidly coupled therewith. One gear is rigidly connected with its unbalanced shaft, while the other gear is rotatably arranged on its unbalanced shaft and is coupled therewith in such a way that it can be shifted in the direction of rotation by shift pins, which are anchored in a slide piece which can be axially shifted in this unbalanced shaft. The shift pins project outwardly through a longitudinal slot in the unbalanced shaft. This other rotatable gear, on both sides, has stop faces which extend nearly radially as well as axially, and point in the same rotational direction. A shift pin is provided on each side of this gear, one end of each shift pin projecting from the unbalanced shaft. Both shift pins are axially spaced from one another, on a common slide piece, by such a distance that one of the shift pins is always located just out of alignment with the stop face on its side of the gear when the other shift pin on the other side has been shifted completely into alignment with the stop face associated therewith, in which connection the angular positioning of the stop faces and/or the shift pins are staggered relative to each other with respect to the unbalanced shaft.

6 Claims, 2 Drawing Figures

OSCILLATOR FOR SOIL OR ROAD TAMPERS

The present invention relates to an oscillator or vibration exciter for soil or road tampers or compacting devices. Unbalanced shafts are journalled parallel to each other in a common housing, and are driven in opposite directions by meshing gears which are placed on the unbalanced shafts. Each shaft supports a centrifugal weight rigidly coupled therewith. One gear is rigidly connected with its unbalanced shaft, while the other gear is rotatably arranged on its unbalanced shaft and is coupled therewith in such a way that it can be shifted in the direction of rotation by at least one shift pin, which is anchored in a slide piece which can be axially shifted in this unbalanced shaft. The shift pin projects outwardly through a longitudinal slot in the unbalanced shaft.

Oscillators of this general type are known from German Offenlegungsschrift No. 24 09 417.

A single shift pin is provided; with the known oscillators, both ends project at diametrically opposite locations from the unbalanced shaft through respective axially parallel slots. The ends of this shift pin respectively engage in helically extending groove segments staggered relative to each other by 180°. These groove segments are embodied internally in the bore of a hub located on the gear and surrounding the associated unbalanced shaft. The relative angular position between the unbalanced shaft and the gear, and hence the phase relationship between the centrifugal weights, is changed during a longitudinal shifting of the shift pin by means of the slide piece in the longitudinal direction of the shaft.

The spiral or helically extending groove segments in the bore of the gear hub are susceptible to wear, and cause difficulties during production.

It is an object of the present invention to simplify the construction of the oscillator of the aforementioned type, and to reduce the susceptibility thereof to wear.

Figure 1:
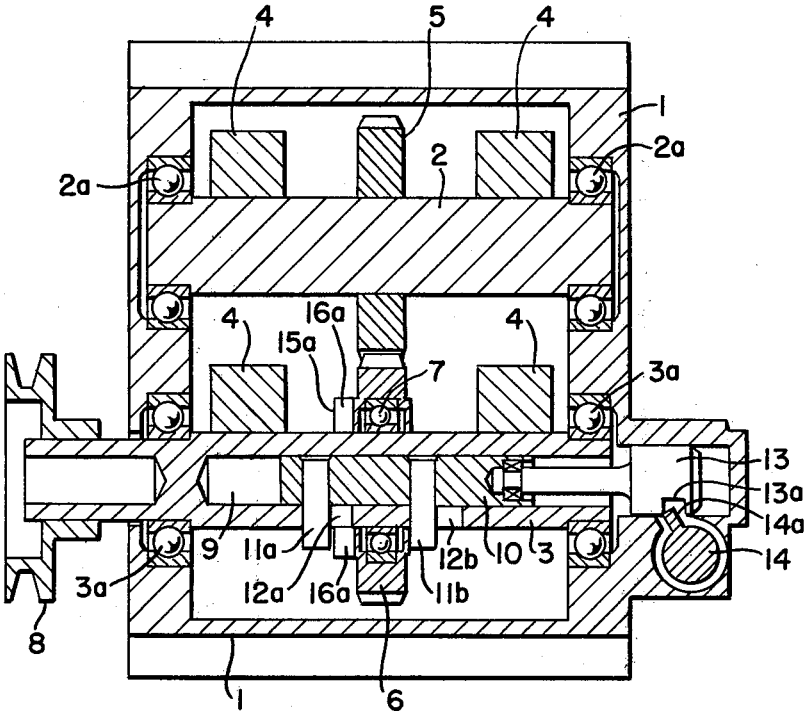
Figure 2:
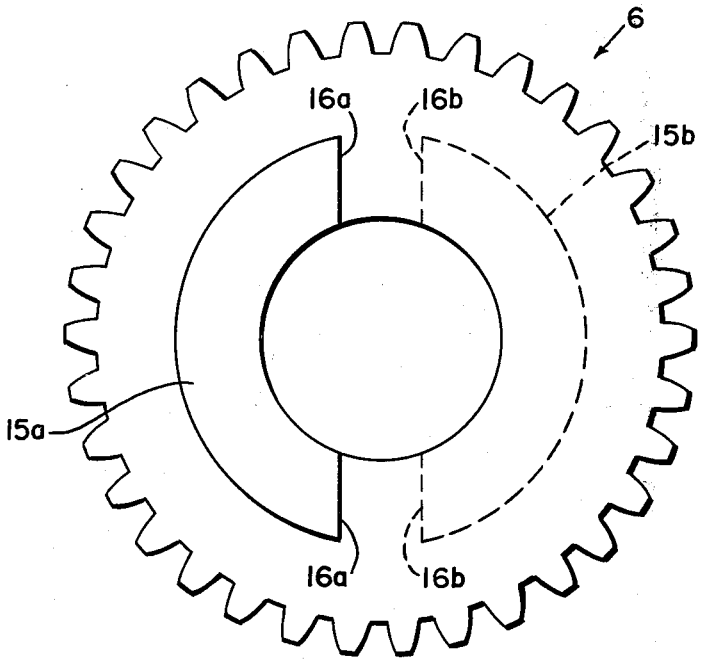

This object, and other objects and advantages of the present invention, will appear more clearly from the following specification in connection with the accompanying drawings, in which:

FIG. 1 is a longitudinal section of one embodiment of the inventive oscillator or vibration exciter, with longitudinal axes of the unbalanced or eccentric shafts lying in the sectional plane; and FIG. 2 is a left side view of the gear located at the bottom of FIG. 1, this gear being rotatably placed on its unbalanced or eccentric shaft.

The oscillator of the present invention is characterized primarily in that both sides of the other rotatable gear are provided with stop faces which extend nearly radially as well as axially, and point in the same rotational direction; in that a shift pin is provided on each side of this gear, one end of each shift pin projecting from the unbalanced shaft; and in that both shift pins are axially spaced from one another, on a common slide piece, by such a distance that one of the shift pins is always located just out of alignment with the stop face on its side of the gear when the other shift pin on the other side has been shifted completely into alignment with the stop face associated therewith, in which connection the angular positioning of the stop faces and/or the shift pins are staggered relative to each other with respect to the unbalanced shaft.

With the inventive oscillator, the gear which is rotatably arranged on its unbalanced shaft can have a simple smooth bore which is easily produced with the necessary tolerances. The stop faces located on the sides of the gear for the two shift pins likewise offer no production difficulties, and are insensitive to wear, as a result of which maintenance is simplified, and the durability is increased. In addition, the inventive oscillator is easy to shift, and practically in a jolt-free or smooth manner, even during operation, because after shifting the shift pins from the one shift position into the other, the unbalanced shaft, which is hereby released relative to the gear for a partial turn, is braked only slowly because of the relatively slight friction which acts counter to its rotation, and the shaft gently engages the stop face, with only slightly reduced speed, with the other shift pin, which is drawn into alignment with that stop face located on the other gear side relative to the previous engagement location.

The change of phase position brought about by a shift operation corresponds to the angle by which a stop face on one gear side is staggered in the direction of rotation relative to the next location of a stop face on the other gear side; in principle, several cooperating pairs of stop faces can be provided, and need have only relatively slight distances therebetween.

According to advantageous further developments of the present invention, the shift pins may have the same angular position with respect to the unbalanced shaft, while the stop faces may be staggered relative to each other by approximately 180°.

The stop faces may be located at the ends of ring segments which extend over approximately 180°, and are mounted on both sides on the gear.

Referring now to the drawings in detail, the illustrated oscillator or vibration exciter has a housing 1 in which two unbalanced or eccentric shafts 2 and 3 are rotatably journalled with the aid of roller bearings 2*a* and 3*a*; the shafts 2,3 are adjacent to and parallel to each other, and support centrifugal weights 4 which are non-rotatably, i.e. positively, connected thereto. Two centrifugal weights 4 are provided on each shaft, and are arranged in the vicinity of the roller bearings.

A gear 5,6 is respectively placed on each unbalanced shaft 2, 3 approximately centrally between the roller bearings and the centrifugal weights. The gears 5 and 6 are embodied as spur gears, and mesh with one another. The gear 5 is positively connected with its unbalanced shaft 2, while the gear 6 is rotatably journalled on its unbalanced shaft 3 with the aid of a roller bearing 7. Both gears 5 and 6 are held so that they cannot be axially shifted relative to their unbalanced shaft 2, 3.

The unbalanced shaft 3, located at the bottom of FIG. 1, extends out from the left side of the housing, and externally of the housing supports a belt pulley 8, by means of which it can be driven. Additionally, the unbalanced shaft 3 is provided with a central longitudinal bore 9, which is open toward the right end of the shaft 3 as seen in FIG. 1. This longitudinal bore 9 extends substantially over the length of the shaft 3 between the two roller bearings 3*a*. A piston-like slide piece 10 is arranged in such a way that it can slide in this bore 9. Two shift pins 11*a* and 11*b*, which are spaced from and parallel to each other, are anchored in the slide piece 10. Each shift pin 11*a*, 11*b* respectively projects from the unbalanced shaft 3, through an axially parallel longitudinal slot 12*a* or 12*b*, on opposite sides of the associated gear 6.

The slide piece 10 can be shifted in the longitudinal direction of the shaft bore 9 by means of a shift piece 13 which is rotatably connected therewith, with the displacement distance being limited by the lengths of the longitudinal slots 12*a* and 12*b*.

The shift piece 13 can be shifted over the displacement distance by means of a shift finger 14*a* which is fixed on a shift shaft 14 and engages in a recess 13*a* of the shift piece 13. The shift shaft 14 extends at right angles to the plane of the drawing of FIG. 1.

The gear 6 is provided with ring segments 15*a*, 15*b* respectively projecting laterally from opposite sides thereof and extending somewhat less than 180°. The ring segments are rigidly connected with the gear 6, and their ends form abutments or stop faces 16*a*, 16*b* which are approximately at right angles to the direction of rotation. The ring segments 15*a* and 15*b* are displaced or staggered relative to each other by 180° as seen in the axial direction of the unbalanced shaft 3.

The clear distance, as measured in the axial direction of the unbalanced shaft 3, between the shift pins 11*a* and 11*b* is only slightly greater than the thickness of the gear 6 plus the thickness of one of the two equally thick ring segments 15*a* or 15*b* (measured in the axial direction of the unbalanced shaft 3). Likewise, the free displacement distance of the shift pins 11*a* and 11*b* in the slots 12*a* and 12*b* is only slightly greater than the aforementioned thickness of the ring segments. These relative dimensions, and the position of the slots 12*a*, 12*b* apparent from FIG. 1, make is possible, by activating the shift piece 13 which axially is rigidly connected with the slide piece 10, at any time to completely align one of the shift pins 11*a* or 11*b* against the stop surfaces of the ring segment on that side, and to simultaneously move the other shift pin on the other gear side entirely out of alignment with respect to the stop faces located there. By means of such a shifting operation, a positive contact between the gear and the unbalanced shaft is established on one gear side, and on the other side, a previously existing corresponding contact is discontinued, whereby each contact change is connected with a slip, between the gear 6 and the unbalanced shaft 3, having an angle of turn of 180°, with the length and relative positioning of the ring segments apparent from FIG. 2.

For each of the two possible turning directions, only one of the two contact surfaces cooperates, as a positively engaging surface, with the associated shift pin on a given side of the gear 6. The other contact surface operates in the opposite direction.

With a larger number of correspondingly shorter ring segments on each gear side, which alternate with the ring segments on the other gear side, it is possible to obtain a slip angle, and consequently phase shifting between the centrifugal weights, of less than 180°.

In place of the cooperating pairs of stop faces on opposite sides of the gear 6, it would also be possible to stagger the shift pins 11*a* and 11*b*, with their longitudinal slots 12*a*, 12*b*, in the direction of rotation, and the shift pins could then cooperate with abutments or stop faces which would be aligned in the longitudinal direction of the unbalanced shaft.

The present invention is, of course, in no way restricted to the specific disclosure of the specification and drawings, but also encompasses any modifications within the scope of the appended claims.

What I claim is:

1. An oscillator, for soil or road tampers, comprising:

a housing;

two unbalanced shafts which are rotatably journalled in said housing and are parallel to each other;

centrifugal weights respectively rigidly connected to said unbalanced shafts;

a first gear rigidly connected with one of said unbalanced shafts;

a second gear rotatably arranged on the other of said unbalanced shafts in such a way that it can also be shifted in the direction of rotation, said first and second gears being adapted to mesh to drive said unbalanced shafts in opposite directions;

stop faces respectively provided on both sides of said second gear, said stop faces extending nearly radially as well as axially, and pointing in the same rotational direction;

a slide piece arranged in, and axially shiftable in, said unbalanced shaft of said second gear; and two shift pins respectively anchored in said slide piece, one on each side of said second gear, for effecting said shifting of said second gear in the direction of rotation, one end of each of said shift pins projecting out of said unbalanced shaft of said second gear through associated longitudinal slots in said last-mentioned unbalanced shaft, said shift pins being axially spaced from one another in said slide piece by such a distance that one of said shift pins is always located just out of alignment with said stop face located on the same side of said second gear when the other of said shift pins, on the other side of said second gear, is in complete alignment with said stop face associated therewith.

2. An oscillator according to claim 1, in which the angular positionings of said stop faces are respectively staggered with respect to said unbalanced shaft of said second gear.

3. An oscillator according to claim 1, in which the angular positionings of said shift pins are respectively staggered with respect to said unbalanced shaft of said second gear.

4. An oscillator according to claim 1, in which the angular positionings of said stop faces, and the angular positionings of said shift pins, are in each case respectively staggered with respect to said unbalanced shaft of said second gear.

5. An oscillator according to claim 2, in which said shift pins have the same angular positioning with respect to said unbalanced shaft of said second gear, and said stop faces are staggered by 180°.

6. An oscillator according to claim 5, which includes a ring segment respectively mounted on each side of said second gear and extending over approximately 180°, each ring segment having two ends which respectively form said stop faces.

* * * * *